United States Patent [19]

Clark et al.

[11] 4,222,817

[45] Sep. 16, 1980

[54] METHOD AND APPARATUS FOR PULPING AND GRADING WASTE MATERIAL

[75] Inventors: Llewellyn E. Clark; John B. Matthew, both of Pittsfield; Bruce E. Nunn, Middlefield, all of Mass.

[73] Assignee: Beloit Corporation, Beloit, Wis.

[21] Appl. No.: 918,943

[22] Filed: Jun. 26, 1978

Related U.S. Application Data

[63] Continuation of Ser. No. 756,357, Jan. 3, 1977, abandoned.

[51] Int. Cl.[2] ..... D21B 1/32

[52] U.S. Cl. ..... 162/4; 162/55; 209/211; 241/46.17

[58] Field of Search ..... 142/4, 55; 209/211; 241/28, 43, 46.17

[56] References Cited

U.S. PATENT DOCUMENTS

| | | | |
|---|---|---|---|
| 2,218,449 | 10/1940 | Cowles | 209/211 |
| 2,220,676 | 11/1940 | Cowles | 241/24 |
| 3,844,488 | 10/1974 | Neitzel | 241/46.17 |
| 3,859,206 | 1/1975 | Baggaley | 209/211 |
| 3,942,728 | 3/1976 | Christ et al. | 241/46.17 |
| 3,945,576 | 3/1976 | Kahmann | 241/46.17 |
| 3,989,197 | 11/1976 | Neitzel | 241/46.17 |
| 4,017,033 | 11/1977 | Tra | 241/28 |

FOREIGN PATENT DOCUMENTS

| | | | |
|---|---|---|---|
| 45-7681 | 3/1970 | Japan | 241/43 |

*Primary Examiner*—William F. Smith

*Attorney, Agent, or Firm*—D. J. Veneman; M. L. Gill; G. A. Mathews

[57] ABSTRACT

Method and apparatus for pulping and grading waste paper in which stock is introduced through a central inlet in one end wall of a cylindrical chamber and accepts are discharged through a perforate screen in the opposite end wall. An impeller in the chamber adjacent the perforate screen provides for pulping and pumping of the stock as well as provides rotational movement of the stock within the chamber. Light rejects are continuously removed through an outlet adjacent the wall containing the perforate screen while heavy rejects are removed through an outlet adjacent the inlet wall.

16 Claims, 4 Drawing Figures

METHOD AND APPARATUS FOR PULPING AND GRADING WASTE MATERIAL

This is a continuation of application Ser. No. 756,357, filed Jan. 3, 1977 now abandoned.

The foregoing abstract is not to be taken as limiting the invention of this application, and in order to understand the full nature and extent of the technical disclosure of this application, reference must be made to the accompanying drawings and the following detailed description.

BACKGROUND OF THE INVENTION

This invention relates to the pulping and grading of waste material and more particularly to the pulping and grading of waste stock intended for use in paper or board making machines.

In one known apparatus for pulping and grading such waste material, the stock to be so pulped and graded is introduced through a tangential inlet to a generally cylindrical chamber. An impeller generally disposed in an end wall remote from the tangential inlet provides for pulping and rotational movement of the stock within the chamber. Accepts pass through a screen in the wall behind the impeller. In an apparatus of this general type disclosed in U.S. Pat. No. 3,844,488, heavy rejects are removed from the chamber through an annular recess while light rejects are permitted to accumulate in the central core of the chamber near the wall opposite the impeller. Periodically the light rejects are tapped off through an axial outlet in the wall opposite the impeller. This apparatus is designed under the assumption that such a pulping and grading machine acts in the nature of a vortex separator.

The rotational movement of the stock within the chamber results in large centrifugal forces and a significant increase in pressure near the outer periphery or cylindrical wall. As a result of the inlet line being located in the outer periphery of the chamber, a significantly large pressure head is required to force the stock into the chamber for processing. Further, the fact that the exact rate of accumulation of lightweight rejects adjacent the central portion of the wall opposite the impeller is not known, and can vary throughout the operation of the apparatus, it is basically guesswork how often and how long the lightweight rejects port should be opened.

SUMMARY OF THE INVENTION

Applicants have discovered that pulping and grading units of the type generally described above act more in the nature of a low power, heavy duty defibering screen rather than a vortex separator. The stock is pulped within the chamber and the accepts pass through the screen behind the impeller. Lightweight rejects tend to concentrate near the radially outer edge of the wall containing the screen. Heavy rejects follow the flow of the fluid radially outwardly and axially away from the impeller and tend to accumulate along the outer cylindrical wall and adjacent the end wall opposite the impeller. The lightweight rejects, therefore, can be continuously tapped off through the cylindrical wall in an area near the end wall containing the screen while the heavy rejects can be tapped off through an outlet in the cylindrical chamber near the wall opposite the impeller. The inlet line, therefore, can be disposed in the wall opposite the impeller and located centrally thereof. Since the inlet line is disposed centrally of the end wall and at axis of rotation, the pressure required to force the stock into the apparatus is reduced quite significantly and in some cases to the extent that it can be introduced into the apparatus merely by gravity.

Applicants have also discovered that quite surprisingly, efficiency of removal of waste material increases as the inlet flow increases.

It is an object, therefore, of the present invention to provide a pulping and grading system with reduced power requirements without significant loss in pulping and separating efficiency.

It is a further object of the present invention to provide a method for pulping and grading waste material with increased power efficiency.

Other objects will be in part apparent and in part pointed out more in detail hereinafter.

The invention accordingly consists in the features of construction, combination of elements and arrangement of parts which will be exemplified in the construction hereinafter set forth and the scope of the application of which will be indicated in the appended claims.

DESCRIPTION OF THE PREFERRED EMBODIMENTS

Figure 1:
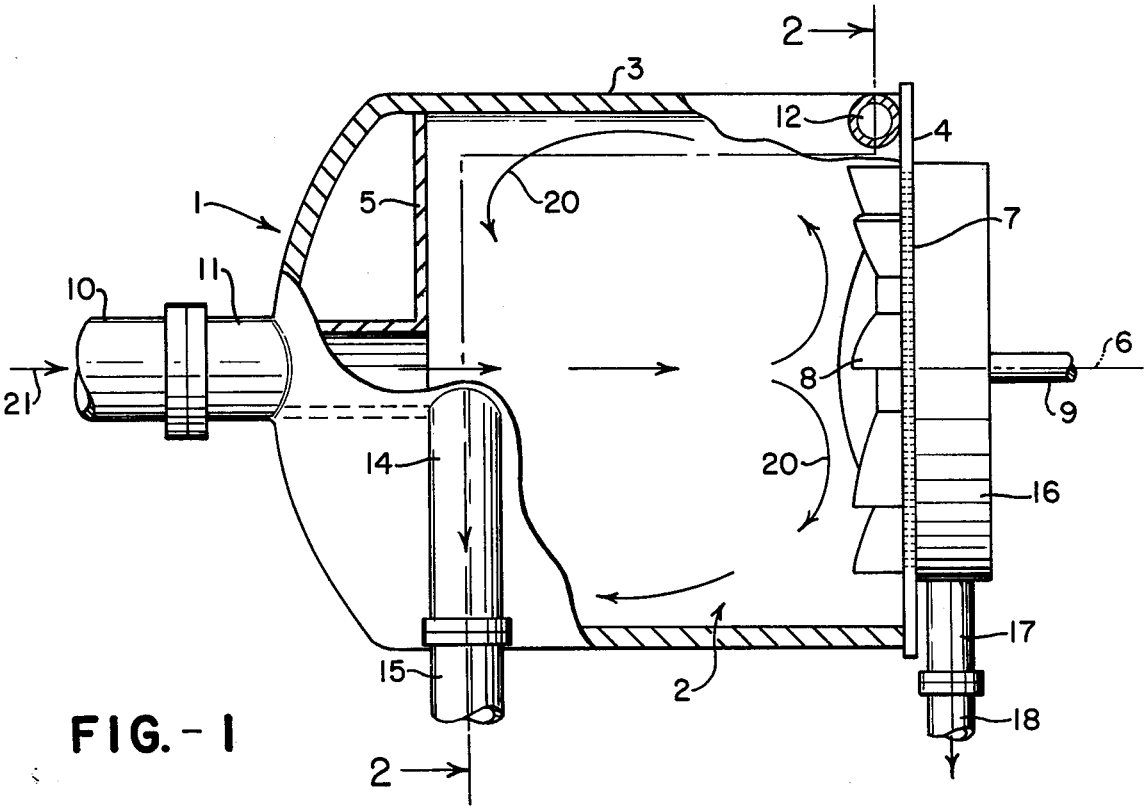
FIG. 1 is a side view of an apparatus constructed in accordance with the present invention with portions broken away.
Figure 2:
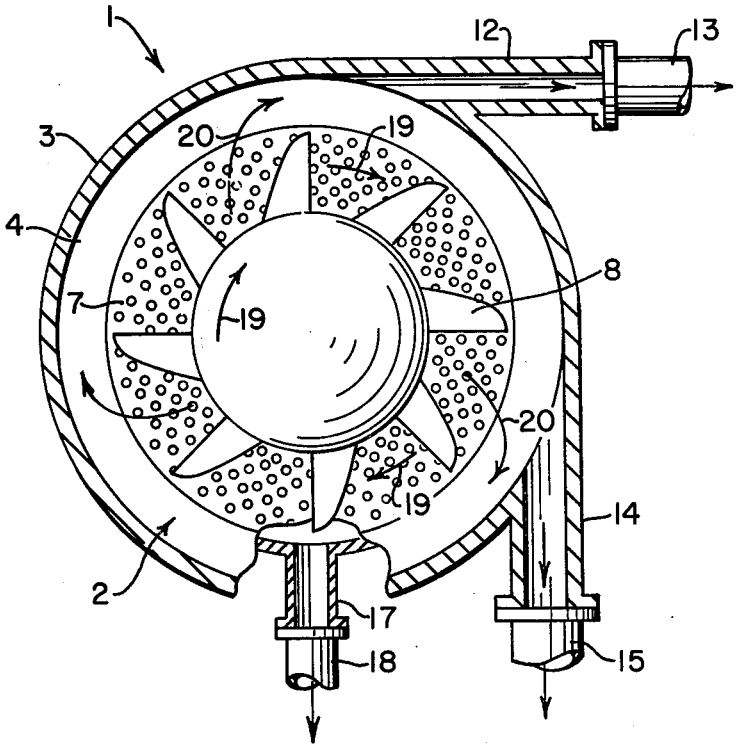
FIG. 2 is a sectional view of the apparatus of FIG. 1 taken substantially along line 2—2 of FIG. 1 with portions broken away.

With reference to the drawings, and in particular FIGS. 1 and 2, there is illustrated an apparatus 1 for pulping and grading waste material, particularly the pulping and grading of waste paper. The apparatus 1 includes a generally cylindrical chamber 2 defined by a substantially cylindrical wall 3, a first end wall 4 and a second end wall 5. While the chamber is illustrated as being truly cylindrical with flat end walls, it will be illustrated that the cylindrical wall need not be perfectly cylindrical nor need the end wall by perfectly flat. The end walls 4 and 5 may, for example, merge with the cylindrical wall 3 through a smooth curve. For purposes of describing the location and orientation of the various parts, an axis 6 extending perpendicularly through the center of both end walls and through the center of the cylindrical chamber will be referred to hereinafter as the central axis 6.

A generally circular perforate area 7 is located centrally in the first end wall 4. This perforate area provides a screening arrangement for permitting accepts to pass through the end wall 4 and may have holes or perforations of whatever size and shape as is desired for most efficient screening of the particular type of stock being used taking into consideration the specific quality and grade of accepts required.

A single impeller only, designated by the numeral 8, is disposed within the chamber in a known manner adjacent the perforate area 7 with its rotational axis coincident with the central axis 6 of the apparatus 1. A shaft 9, which is connected to a source of rotational power, (not illustrated) extends through the end wall 4 and is operably connected to the impeller 8 to impart rotational motion thereto.

In accordance with the present invention, a supply line or pipe 10 is connected to an inlet nozzle 11 disposed centrally within the second wall 5. The inlet nozzle 11 therefore, has its center coincident with the central axis 6 of the chamber 2 and provides for stock to enter the chamber 2 through the second end wall 5 and at a point directly opposite the impeller 8 adjacent the perforate area 7.

A light rejects nozzle 12 is located in the apparatus 1 in an area disposed radially outwardly of the perforate area 7. More specifically, the light rejects outlet 12 is located in the cylindrical wall 3 and next adjacent the first end wall 4. Further, as best seen in FIG. 2, the light rejects nozzle 12 exits from the cylindrical wall 3 in a direction which is tangent to the cylindrical wall 3 and is connected to a light rejects pipe 13. Although it is not illustrated it may be desirable to have a pump connected to the pipe 13 for assisting in transporting light rejects to the next point in the process.

A heavy rejects outlet 14 is disposed in the cylindrical wall 3 near the second end wall 5. In the specific embodiment illustrated, the heavy rejects outlet 14 is disposed next adjacent the first wall 5. This provides the heavy rejects outlet at the point of last migration of heavy particles along the cylindrical wall 3 thus avoiding the buildup of heavy rejects adjacent the second wall 5 which can continue to whirl around the chamber causing excessive wear. Also, as best seen in FIG. 2, the heavy rejects outlet extends in a direction tangent to the cylindrical wall 3 and is connected to a rejects pipe 15.

An accepts chamber 16 is connected to the first wall 4 and encloses the area outside the chamber 2 adjacent the perforate area 7 for receiving accepts passing through the perforate area or screen 7. An exit 17 is connected to the accepts chamber 16 and in communication with an accepts pipeline 18.

Particularly with reference to FIG. 2 in the particular embodiment illustrated, the rotation of the impeller is indicated by the arrow 19. Thus, it can be seen that not only are the light rejects outlet 12 and heavy rejects outlet 14 disposed in directions tangential to the cylindrical wall 3, but they also are arranged to extend in the general direction of the rotation of the impeller 19. The impeller 19 imparts a pumping and whirling motion to the slurry or stock within the chamber, generally in the direction of the arrows 20. The stock, therefore, enters the inlet line at 11 generally indicated by the arrow 21. The inlet nozzle 11 extends in a direction parallel to the central axis 6 to provide that the stock enters the chamber 2 in a direction along the central axis 6 and toward the impeller 8. The impeller 8 provides a pulping action and imparts the whirling motion described above which causes the stock to rotate through the chamber 2 in the direction of the arrows 20 illustrated in FIG. 2. The whirling stock proceeds rearwardly from the first wall 4 toward the second wall 5, as illustrated by the arrows 20 in FIG. 2.

Accepts pass through the screen 7 into the accept chambers 16 and subsequently out through the outlet nozzle 17. Fine rejects become concentrated adjacent the first wall 4 and are continuously tapped off through the light rejects line 12. Heavy rejects are thrown radially outwardly by centrifugal force and migrate rearwardly toward the second wall 5 and are rejected through the heavies reject nozzle 14.

The apparatus of the present invention was compared with a known apparatus with respect to inlet pressure requirements and capability of separating light weight rejects, i.e., rejects having a specific gravity less than 1. The standard apparatus included a generally cylindrical chamber having a first end wall with a perforate area and an impeller next adjacent thereto. The second end wall was disposed opposite the first end wall with a light rejects nozzle disposed at the axial center thereof. The stock inlet was tangential to the cylindrical wall and located adjacent the second wall. The standard apparatus, therefore, was substantially the same as the apparatus of the present invention with the exception that the inlet of the standard apparatus was located in the cylindrical wall in a known manner and the light rejects outlet was located centrally in the end wall opposite the impeller in a known manner.

Figure 3:
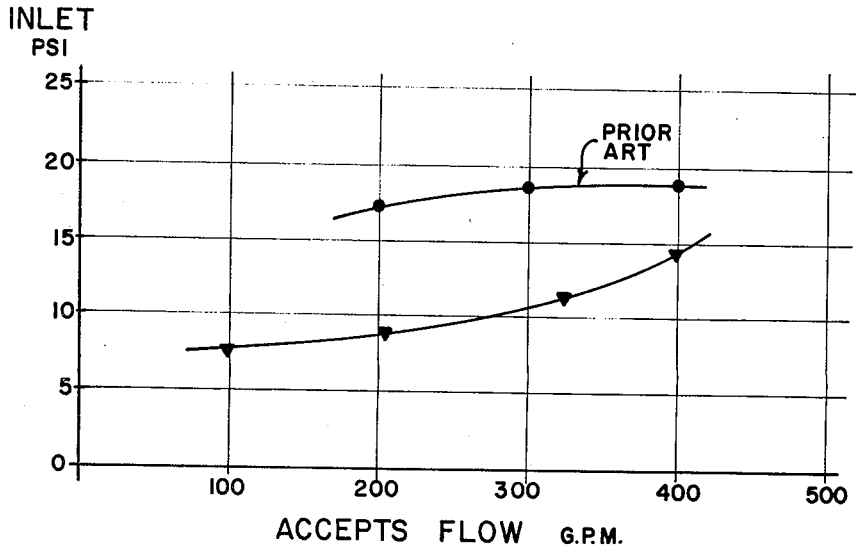
FIG. 3 is a graph illustrating the inlet pressure requirements of the method and apparatus of the present invention compared to a prior art method and apparatus.
Figure 4:
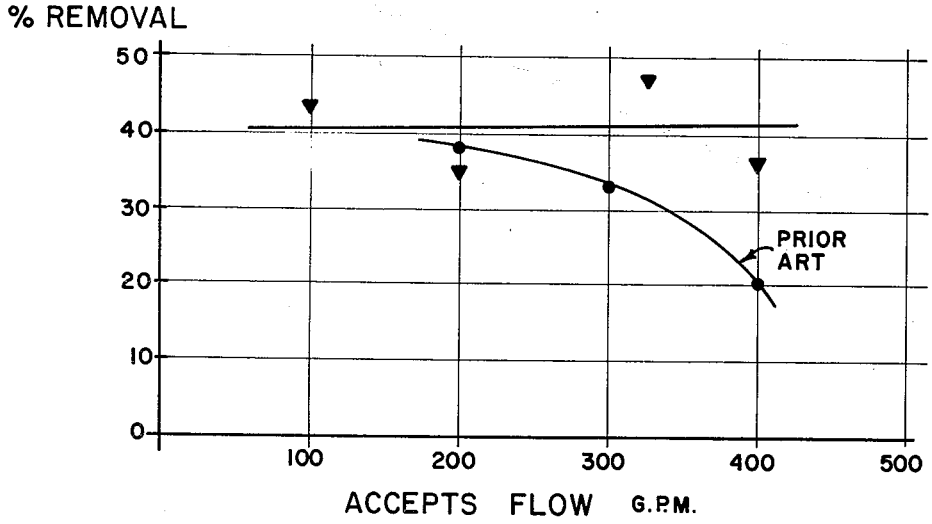
FIG. 4 is a graph illustrating the lightweight rejects removal efficiency of the method and apparatus of the present invention compared to a prior art method and apparatus.

As illustrated in the following table and in FIGS. 3 and 4, the required inlet pressure for a given accept flow was significantly less for the apparatus constructed in accordance with the present invention.

TABLE

| | GPM ACCEPTS FLOW | PSI INLET PRESSURE | % OF LIGHT WEIGHT REJECTS REMOVAL |
|---|---|---|---|
| Prior Art | 200 | 17 | 38.4 |
| Separator | 300 | 18.5 | 32.7 |
| | 400 | 18.5 | 20.0 |
| Separator of | 100 | 7.75 | 41.7 |
| Present | 205 | 8.5 | 34.9 |
| Invention | 320 | 11 | 47.2 |
| | 400 | 14 | 37.5 |

The efficiency in removing lightweight contaminates or the percent of lightweight rejects removed, was significantly greater with the apparatus constructed in accordance with the present invention, particularly at the higher flow rates. This is particularly valuable since heretofore separators of the general type described have decreased in efficiency of removal of lightweight rejects as the accepts flow rate increased. The apparatus of the present invention, however, provides essentially no decrease in efficiency of removal of lightweight rejects as the accepts flow increases.

It can be seen, therefore, that the present invention provides an apparatus and a method for pulping and separating waste material which substantially reduces the inlet pressure required with no significant loss in efficiency of removal of lightweight rejects and, in fact, provides improvement in the removal of lightweight rejects at higher flow rates. This permits an increase in flow and thus an increase in production and at the same time an increase in the rate of removal of lightweight rejects. In addition, all this is accomplished with a reduction of power requirements to get the stock into the pulper/separator and sometimes with the inlet pump eliminated altogether.

While this specific representative embodiment and details have been shown for the purpose of illustrating the invention, it will be apparent to those skilled in this art that various changes and modifications may be made therein without departing from the spirit or scope of the invention.

What is claimed is:

1. An apparatus for pulping and grading waste material, particularly for the pulping and grading of waste paper, said apparatus comprising:

a cylindrical chamber having a first end wall, a second end wall, a cylindrical wall and a central axis extending through said chamber and both end walls thereof;

a perforate area disposed in said first wall and spaced a limited distance from said cylindrical wall;

a single impeller only in said chamber adjacent said perforate area and having its rotational axis coincident with said central axis to provide rotational motion of the waste material in the chamber about the central axis concurrently with movement of said material radially outwardly adjacent to said perforate area and back toward said second wall;

means to supply material to said chamber comprising inlet means disposed centrally in said second end wall;

means to remove lightweight rejects from said chamber comprising a first outlet means disposed in said cylindrical wall;

means to remove heavy rejects from said chamber comprising:

a second outlet means disposed adjacent said second wall; and means providing a takeoff chamber to receive a stream of accepted material passing through said annular perforate area.

2. An apparatus as claimed in claim 1 wherein the outlet for lightweight rejects is located in said cylindrical wall next adjacent said first wall.

3. An apparatus as claimed in claim 1 wherein the outlet for heavy rejects is located next adjacent said second wall.

4. An apparatus as claimed in claim 3 wherein the outlet for light rejects is located in said cylindrical wall next adjacent said first wall.

5. An apparatus as claimed in claim 2 wherein the outlet for light rejects is tangential to said cylindrical wall and arranged to discharge the light rejects in the direction of rotation of said impeller.

6. An apparatus as claimed in claim 5 wherein the outlet for heavy rejects is disposed adjacent said second wall, is tangential to said cylindrical wall and is arranged to discharge the heavy rejects in the general direction of rotation of said impeller.

7. An apparatus as claimed in claim 1 wherein said inlet means has its axis parallel to and coincident with said central axis for a sufficient length of said inlet means such that the waste material enters said cylindrical chamber in a direction along said central axis and toward said impeller.

8. An apparatus as claimed in claim 4 wherein said inlet means has its axis parallel to and coincident with said central axis for a sufficient length of said inlet such that the stock enters said cylindrical chamber in a direction along said central axis and toward said impeller.

9. An apparatus as claimed in claim 6 wherein said inlet means has its axis parallel to and coincident with said central axis for a sufficient length of said inlet such that the stock enters said cylindrical chamber in a direction along said central axis and toward said impeller.

10. In a method of pulping and grading waste paper for use in making paper and the like in a separator unit of the type having a chamber defined by a cylindrical wall, a first end wall having a perforate screen and a second end wall opposite said first end wall and further including one impeller only in said chamber adjacent said first wall to provide rotational movement of said material concurrently with movement of said material radially outwardly in the area of said impeller and back toward said first wall, the improvement comprising:

introducing waste paper through an inlet in the axial center of said second end wall;

removing heavy rejects from an outlet in said chamber in an area near said second end wall;

removing lightweight rejects through an opening in said chamber which is disposed in said cylindrical wall and is separate from the outlet for said heavy rejects; and, removing accepted material which passes through said perforate screen.

11. A method as claimed in claim 10 wherein said light rejects are removed from said chamber through an outlet located in said cylindrical wall and disposed next adjacent said first end wall.

12. A method as claimed in claim 10 wherein the light rejects are removed from an outlet located in said cylindrical wall and disposed next adjacent said first end wall.

13. A method as claimed in claim 12 wherein said light rejects and said heavy rejects are removed from said chamber respectively in directions which are tangential to said cylindrical wall and in the direction of rotation of said impeller.

14. A method as claimed in claim 10 wherein said waste paper is introduced into said chamber along the central axis thereof and in a direction toward the impeller.

15. A method as claimed in claim 12 wherein said waste paper is introduced into said chamber along the central axis thereof and in a direction toward the impeller.

16. A method as claimed in claim 13 wherein said waste paper is introduced into said chamber along the central axis thereof and in a direction toward the impeller.

* * * * *